US010899489B2

(12) United States Patent
Dijkstra et al.

(10) Patent No.: US 10,899,489 B2
(45) Date of Patent: Jan. 26, 2021

(54) PROCEEDING AND ARRANGEMENT TO APPLY LABELS

(71) Applicant: Evolabel AB, Mölndal (SE)

(72) Inventors: Gerard Dijkstra, Mölndal (SE); Jonas Södergård, Gothenburg (SE)

(73) Assignee: EVOLABEL AB, Molndal (SE)

( * ) Notice: Subject to any disclaimer, the term of this patent is extended or adjusted under 35 U.S.C. 154(b) by 108 days.

(21) Appl. No.: 16/071,946

(22) PCT Filed: Jan. 20, 2017

(86) PCT No.: PCT/SE2017/050055
§ 371 (c)(1),
(2) Date: Jul. 23, 2018

(87) PCT Pub. No.: WO2017/131573
PCT Pub. Date: Aug. 3, 2017

(65) Prior Publication Data

US 2019/0023443 A1 Jan. 24, 2019

(30) Foreign Application Priority Data

Jan. 26, 2016 (SE) ..... 1650086

(51) Int. Cl.
*B65C 1/02* (2006.01)

(52) U.S. Cl.
CPC ..... *B65C 1/021* (2013.01)

(58) Field of Classification Search
CPC ..... B65C 1/021; B29C 66/863
See application file for complete search history.

(56) References Cited

U.S. PATENT DOCUMENTS 5,540,795 A 7/1996 Franklin et al.
2015/0225104 A1 8/2015 Reed

FOREIGN PATENT DOCUMENTS

FR 3013334 A1 * 5/2015 ..... B65C 9/1884
JP 2004244078 A 9/2004
JP 2011020688 A * 2/2011 ..... B65C 1/021
(Continued)

OTHER PUBLICATIONS

Extended European Search Report for European Application No. 17744647.3; Date of Completion: Apr. 1, 2020; dated Apr. 9, 2020; 8 Pages.

(Continued)

*Primary Examiner* — Carson Gross
(74) *Attorney, Agent, or Firm* — Cantor Colburn LLP

(57) ABSTRACT

A method and an arrangement to apply labels on marking objects which are transported on a track. By only two swinging arms, the output printed label is transported away from the label printer, in a first direction of travel, so that the adhesive side of the label is facing the first direction of travel of the label applicator plate, and in an opposite second direction of travel, so that the printed side of the printed label is faces the second direction of travel of the label applicator plate. Continued motion actuation of the label applicator plate by turning the swinging arm carrying the applicator plate and, where appropriate, rotation of the applicator plate provides transportation of the label to and delivery of the label at and application of the label on the marking object with the adhesive side of the label facing the marking object.

7 Claims, 14 Drawing Sheets

(56) References Cited

FOREIGN PATENT DOCUMENTS

Figure 1:
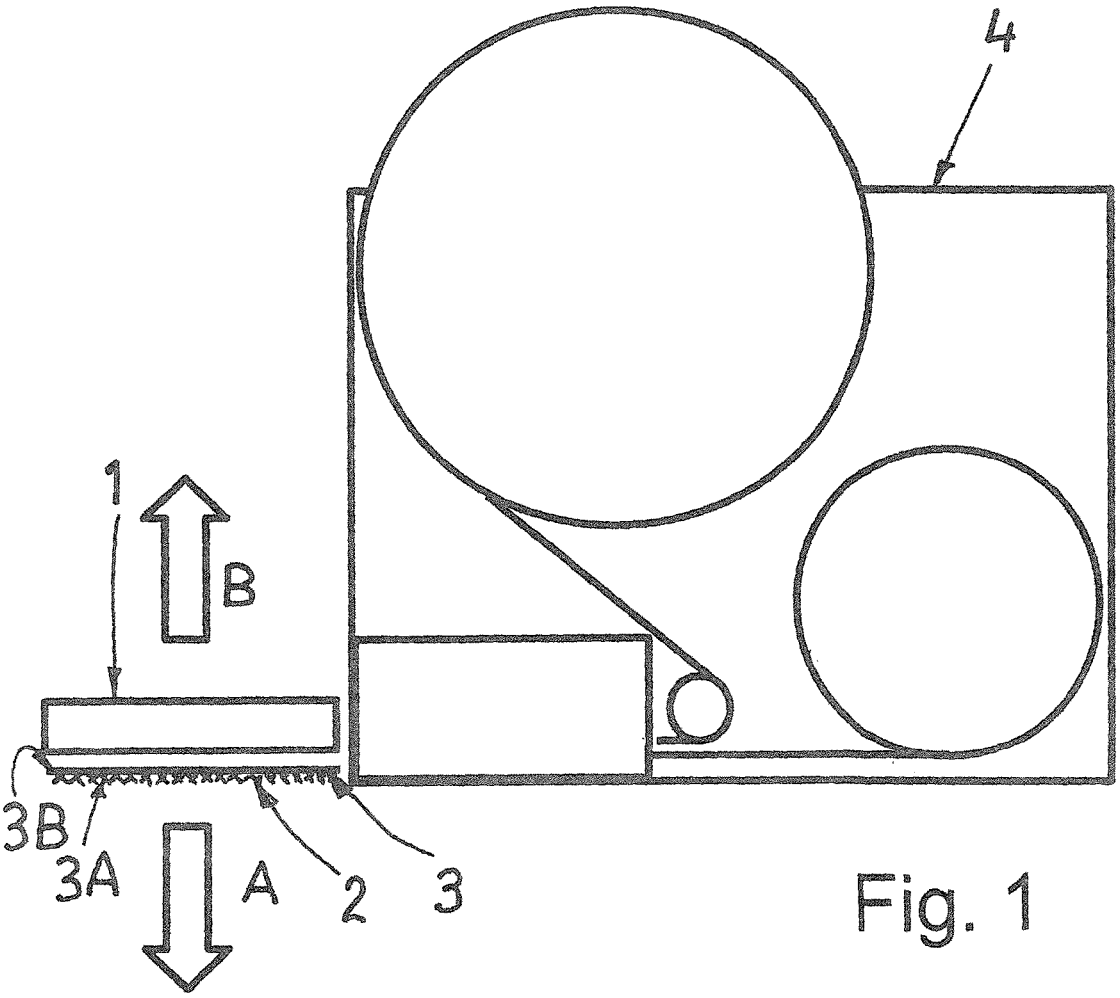

| | | | |
|---|---|---|---|
| JP | 2011020688 | A | 2/2011 |
| NL | 1000055 | C1 | 8/1995 |
| WO | 9815459 | A1 | 4/1998 |

OTHER PUBLICATIONS

Sweden Patent and Registration Office, Int'l Search Report in PCT/2017/050055, dated May 8, 2017.
Sweden Patent and Registration Office, Int'l Preliminary Report on Patentability in PCT/2017/050055, dated Apr. 26, 2018.

* cited by examiner

PROCEEDING AND ARRANGEMENT TO APPLY LABELS

The present invention concerns a proceeding for, by means of a label applicator plate, collecting, transporting, and delivering labels provided with adhesion agent from a label printer to intended marking object, such as cartons, pallets with goods, bundles of items, sacks, barrels, etc., which are transported on a conveyor track.

The invention also concerns an arrangement to apply labels on marking objects that are movable along a conveyor track.

Known solutions for marking by the application of labels on up to three sides of intended marking objects, such as cartons, pallets with goods, bundles of items, sacks, barrels, etc., require at least three different movements of label applicator plate utilized therefor. The movements may in that connection be solely rotary but are usually a combination of rotary and linear movements. Disadvantages thereof are in particular:

- It is not possible to mark on three sides without needing to halt the marking object, i.e., on the front side, the opposed side, and the back side of the marking object.
- To utilize many joints increases the cost. If a robot arm is used, it may be safer but it becomes, as said, expensive with many arms and joints.
- By the fact that known solutions most often comprise a linear movement, a significant risk of crushing arises between the applicator and the marking objects. This is particularly dangerous and serious as for the marking of heavy objects, which often is the case for loading pallets with load and which are transported on a track past the application equipment in question.

Known solutions for the marking of only two sides of the marking object normally have between one and three joints but have the following disadvantages:

- If the marking and, accordingly, application of label should be made while moving, three movements are required, wherein an expensive construction has to be installed for being able to manage paired flow directions. Usually, simpler and more inexpensive solutions are used for such applications with one or two movements. Then, the purchaser has to in advance know which model that should be procured.
- Known solutions require at least three movements and are expensive in case that they should be possible to be upgradable to mark three sides.
- Known solutions require three movements for managing two-side marking with check reading and with one stop. If two movements are utilized, two stops are required.

JP 2011020688 A concerns a robot 16 where a plurality of arms 32-35 are movable to be able to move a label applicator plate 15 from a receiving position P1 at a label output machine 12 to a marking position P2 on an object W. The arms can both be turned and rotated into desired positions in directions B-E. Thus, a perilous and expensive robot.

US 2015/0225104 A1 concerns labelling system and method for container where a label machine comprises an upright along which the label applicator of the machine is displaceable in different directions, accordingly by means of displaceable elements, see, e.g., FIGS. 11, 6*a*, 5, and 15.

NL 1000055C C1 concerns a machine to apply labels on loading pallet load, wherein an arm 4 is present which turns 90° and has a label applicator plate in the end of said arm 4 and which plate is rotatable 90°. It maybe could apply label also to the long side of the loading pallet if the arm 4 would be arranged to be turned further 180° and if the label output device 2 could duck so that the arm 4 could pass above the same. But this does not seem to be the case with that one.

The idea of the present invention is about an entirely new way to design a label applicator that can apply labels to several sides of an object, guaranteed without risks of crushing and with fewer parts. In addition, the guiding of the products to be marked can often be simplified.

The applicator is meant to be used for labelling a wide spectrum of products, even if the most common applications probably will be marking of pallets and cartons. Other examples are bundles of planks or deals, sacks, barrels, etc.

The applicator focuses in particular on, and is unique in applications where labels should be applied to two or three sides of a product.

In two-side marking within Secondary Packaging, i.e., cartons, trays, or the like, the marking most often takes place while moving and check reading of printed bar-code normally takes place only on one of the labels. Upon rejected reading, the marking object is normally sent off the conveyor track.

In two-side marking of so-called Tertiary Packaging, or pallet marking, marking may be made while moving or by stopping the pallet. The reason for halting the pallet is to be able to check read both labels, and upon error be able to make a new printout, application, and check reading. If you still do not succeed, the conveyor track is normally halted and error is reported.

In three-side marking of pallets, today the pallet has to be halted irrespective of whether there are requirements of check reading all labels. This depends on there has not been any solutions on the market that handle marking of three sides while moving.

Thus, the main object of the present invention is primarily to solve, by a proceeding and an arrangement, among others the problems mentioned above simply and cost-effectively.

Said object is achieved by a proceeding of the type mentioned, which essentially is characterized in that, by means of only two swinging arms, the output printed label is transported away from the label printer, in a first direction of travel, so that the adhesive side of the label is facing said first direction of travel of said label applicator plate, as well as in an opposite second direction of travel, so that the printed side of the printed label is facing said opposite second direction of travel of said label applicator plate, wherein continued motion actuation of the label applicator plate by turning the swinging arm carrying the applicator plate, and where appropriate provides rotation of the applicator plate, provides transportation of the label to, and delivery of the label at, and application of the label on the marking object with the adhesive side of the label facing said marking object, and that only two pivot joints and two swinging arms are present for carrying a label applicator plate and for allowing placing the labels on desired spots on one long side of the marking object in question as seen in the direction of transportation and on the two end portions of the marking object, that the arm, the primary arm, that is situated closest to the label printer is turnable 360°, and that the additional arm, the secondary arm, which carries the label applicator plate, is turnable at least 200°, but most preferably 360°, the swinging arms being arranged with such lengths and with such pivot joints that application is allowed to the side of the marking object that is situated essentially parallel to, as well as perpendicularly to the direction of transportation, of the marking object.

Figure 2:
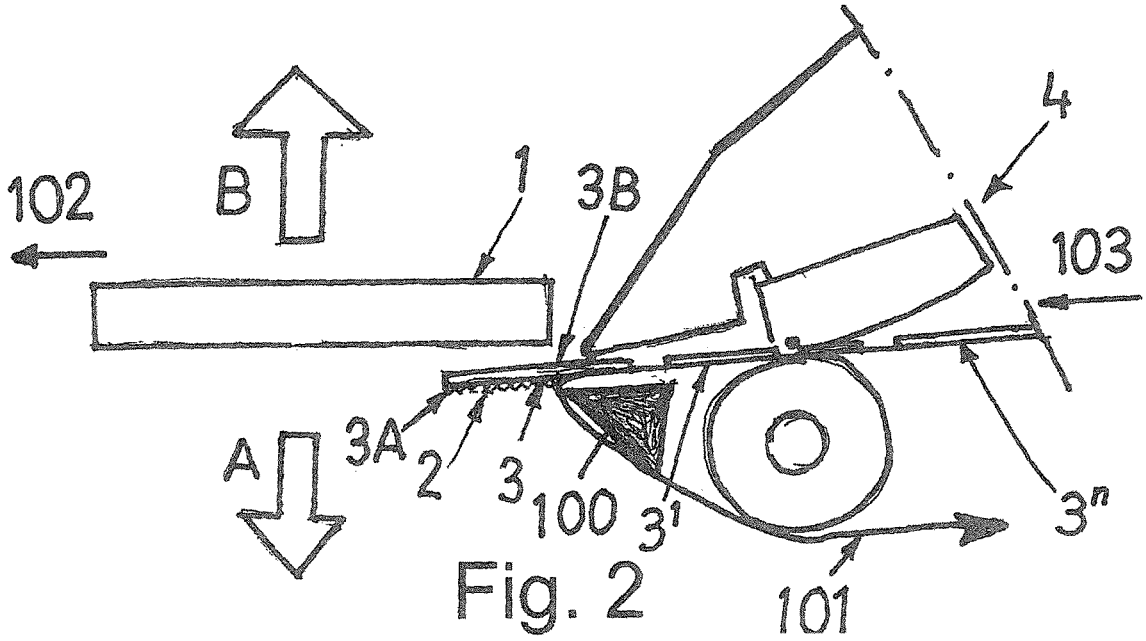
Figure 3:
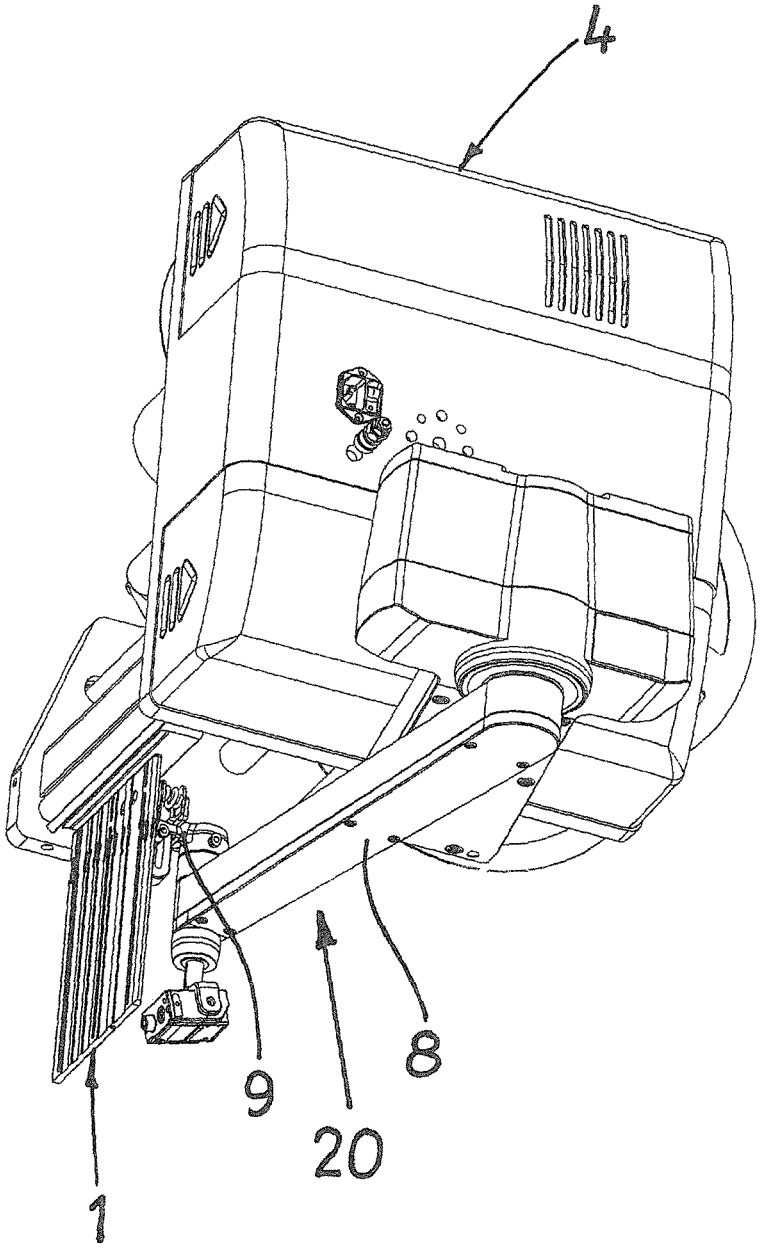
Figure 4:
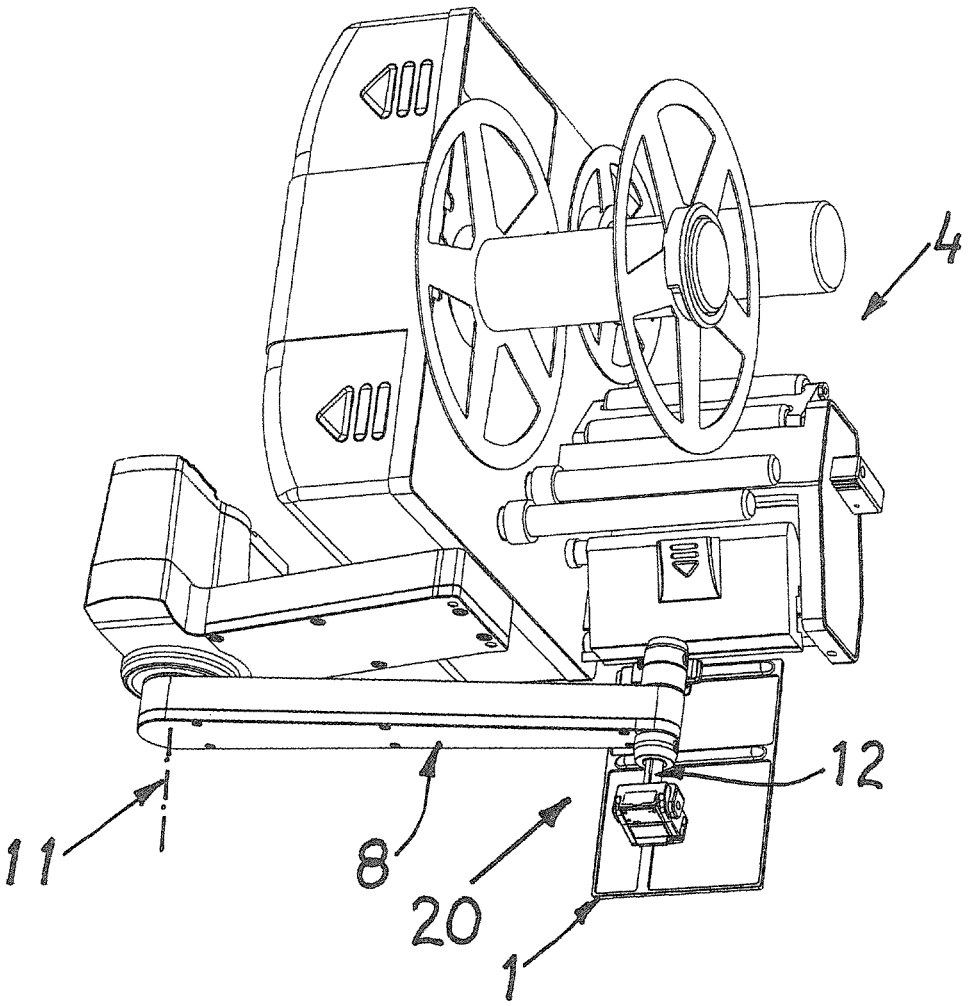

The invention is described below in the form of a preferred embodiment example, reference being made to the accompanying drawings, in which FIG. 1 schematically shows a side view of a label output part of a label printer with shown arrowed label fetching directions, FIG. 2 shows the proper label output to a label applicator plate, FIGS. 3 and 4 show an arrangement at a label printer to apply printed labels that are fed out from the label printer and as seen from diametrically opposed sides of the arrangement, FIGS. 5-9 show label application in a first position, and FIGS. 10-15 show label application at a second position along a conveyor track.

The new technique is above all unique by the fact that it can transport away the label from the printer in two different ways. All products on the market transport away the label from the printer so that the adhesive side ends up in the direction of travel. The new technique involves that the label may be transported away in the usual direction or in the opposite direction so that the printed side of the label ends up in the direction of travel. This imposes particular requirements of the design of the printer since no parts must be positioned in the way of the label in any one of the two directions at the printer's extreme point. Thus, what is new is that the label leaves the printer in two different directions.

This new way of thinking makes that an applicator with only two rotary movements gives the following large advantages in marking on three sides:

- Since only two movements are used, and the two are rotary, the machine becomes harmless, i.e., there are no risks of crushing between marking object and applicator. If someone ends up between these, the applicator is rotated away thanks to weak force of the rotary movements.
- In spite of only two movements, just two stop positions are required if check reading is a requirement. Existing technique requires three movements for managing three sides, and requires often also three stops.
- Three sides can be marked while moving if check reading is not a requirement. There is no existing technique that manages this today.
- Since it is now possible to use two instead of three movements, the new technique becomes more inexpensive.

This new way of thinking for an applicator having only two rotary movements gives the following large advantages in marking on two sides:

- The new technique allows marking two sides while moving regardless of the direction of flow of the marking objects using the same applicator. This means that it is not necessary to know in advance where the machine should be placed and the production can be reconstructed after delivery.
- The applicator can be upgraded afterwards to mark on three sides without mechanical changes.

Another very major advantage is that the new technique makes the machine very compact compared with existing technique. This makes that the machine can be placed much more unrestricted. It is unfortunately quite the regular thing that the very labelling enters late in the planning of marking plants and lack of space is common.

With reference to primarily FIGS. 1-5, a proceeding for, by means of a label applicator plate 1, collecting, transporting, and delivering labels 3 provided with adhesion agent 2 from a label printer 4 to intended marking object 5, such as cartons, pallets 6 with goods, bundles of items, e.g. timber, sacks, barrels, etc., which is transported on a track 7, comprises that the label applicator plate 1 is allowed to move away the printed label 3 in different directions A and B, respectively.

More precisely, the output printed label 3 is transported away in a first direction of travel A, so that the adhesive side 3A of the label is facing said first direction of travel A of said label applicator plate 1, as well as in an opposite second direction of travel B, so that the printed side 3B of the printed label is facing said opposite second direction of travel B of said label applicator plate 1, wherein continued motion actuation of the label applicator plate 1 provides transportation of the label 3 to, and delivery of the label at, and application of the label 3 on marking object 5. The labels are held in place on the applicator plate 1 by means of suction power.

According to the invention, the label is transported 3 in said two directions of travel A and B using one and the same label applicator plate 1.

When fed out label 3 has passed the output portion of the printer 4, i.e., the outer dispenser edge 100 thereof (breaking edge for fed out label, where the label is separated from subjacent backing paper 101), the label 3 is free to be transported by the label applicator plate 1 in either direction of travel A, B.

Figure 5:
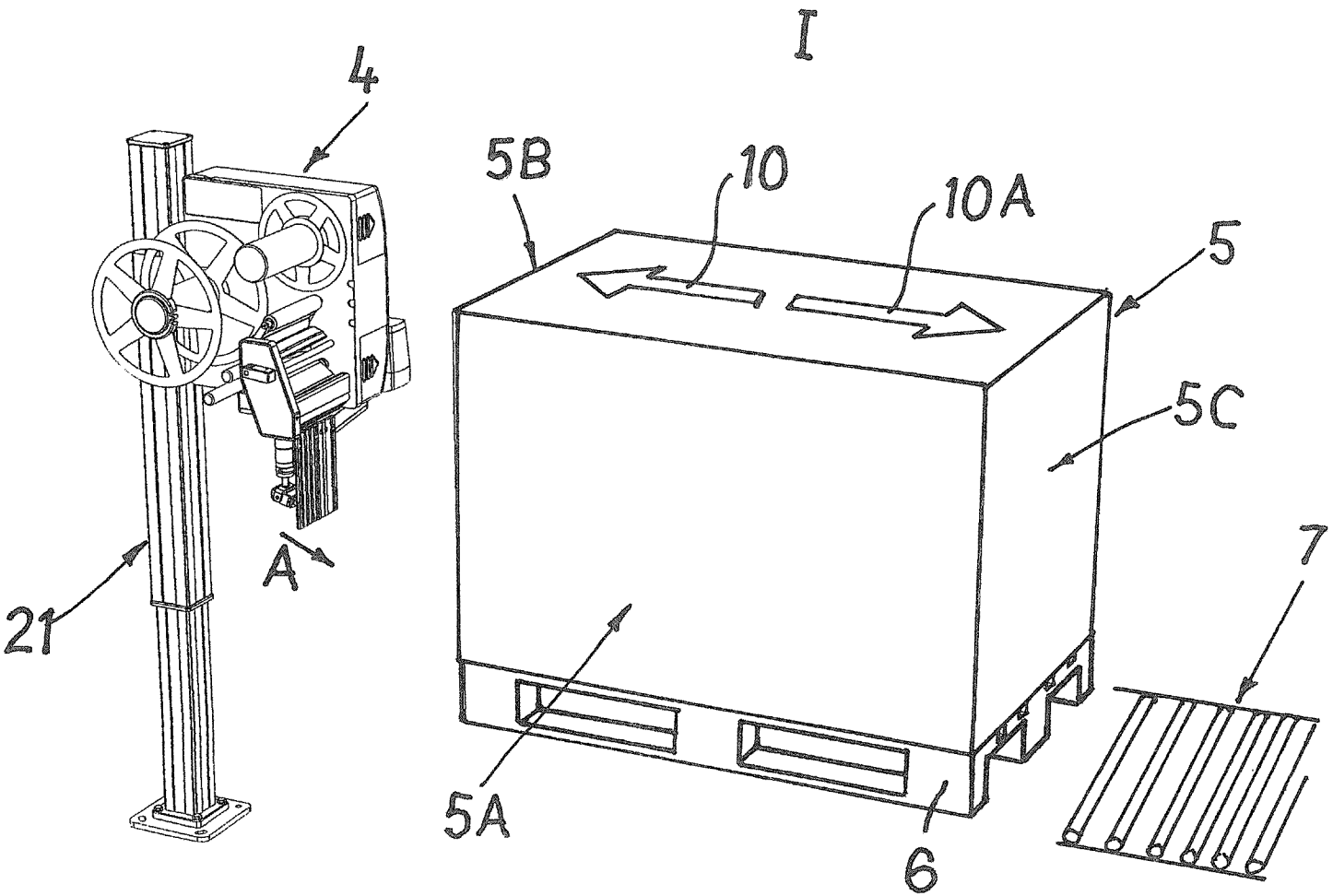
Figure 6:
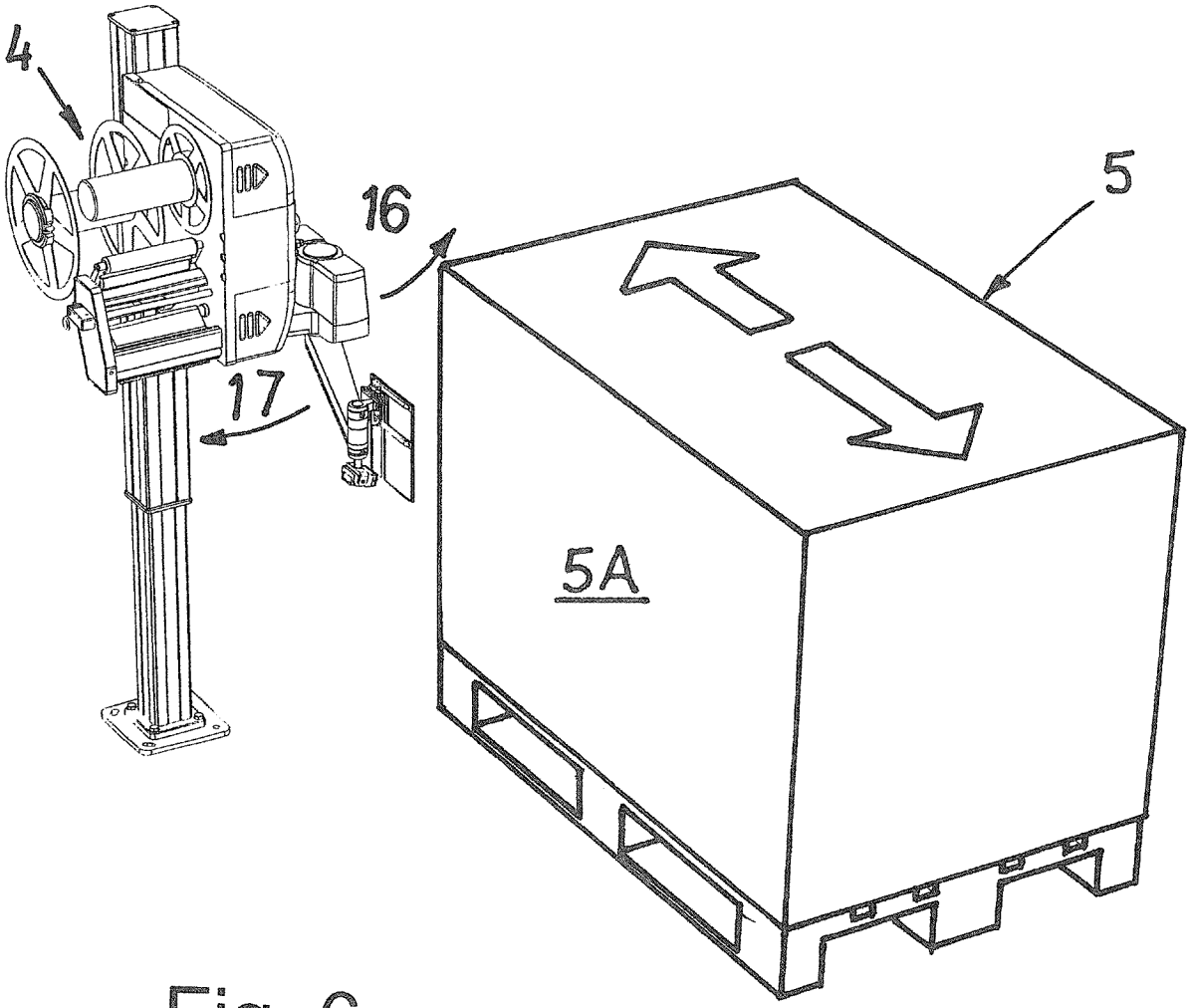
Figure 7:
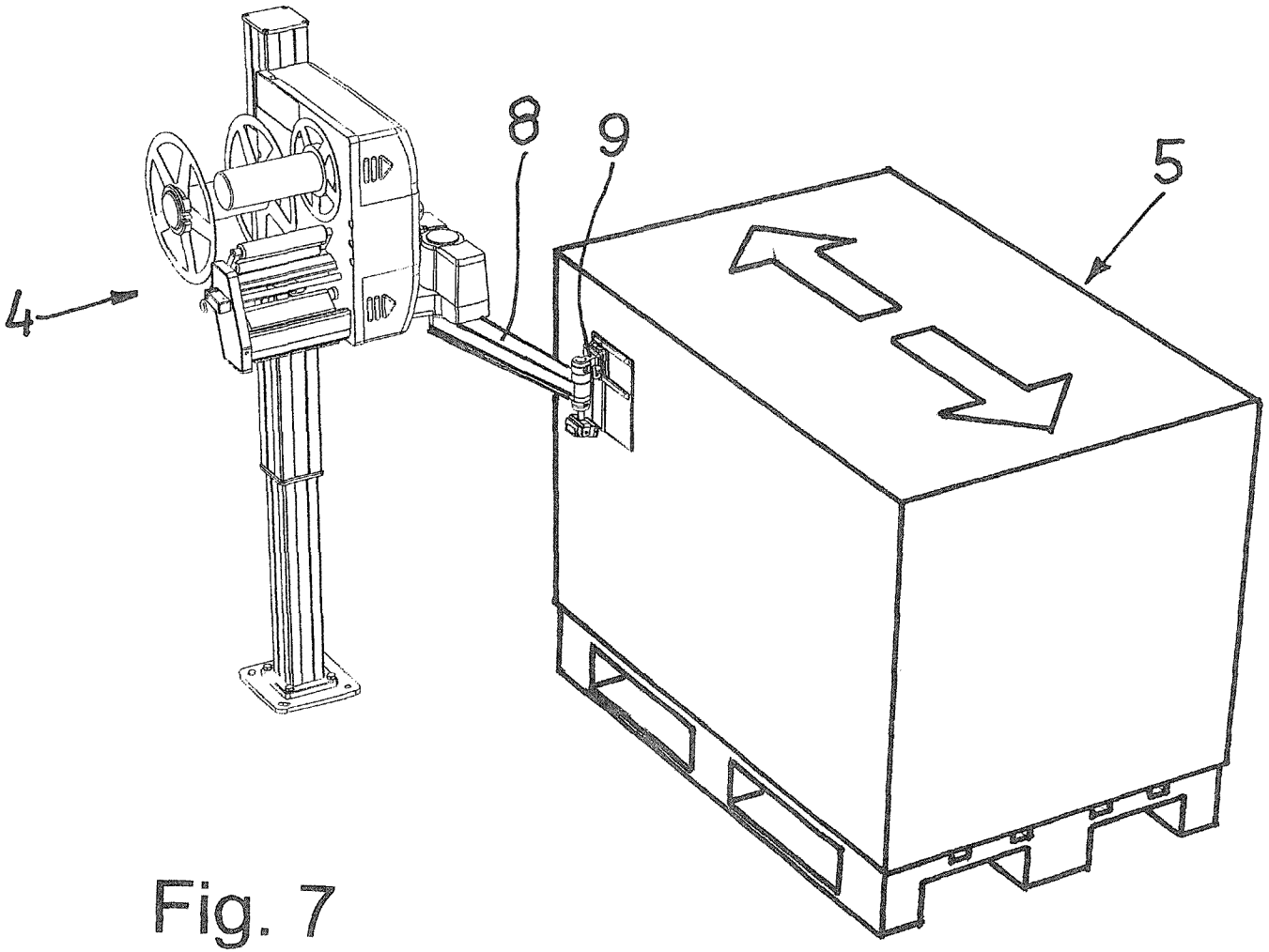

According to the invention, the label applicator plate 1 in question is moved so that application of labels 3, $3^1$, $3''$ is allowed on two sides 5A, 5B and 5A, 5C, respectively, of a marking object 5 in question with the marking object 5 not moving by two movements of the swinging arm 8, 9, viz. rotary or linear movements. The invention allows application of labels 3-3″ by means of the applicator plate 1 on three sides 5A, 5B, 5C of the marking object 5, and that with only two movements I and II, respectively. As shown in FIGS. 5-7, a first application of a label 3 on a marking object 5 is illustrated, on the front part thereof on the opposed side 5A of the marking object 5, when the loading pallet 6, which the marking object 5 is carried by, moves in the direction of transportation 10. The application may in that connection take place either while moving when the loading pallet 6 moves on the conveyor track 7 or after the loading pallet has been stopped. In doing so, the label applicator plate 1 starts and seizes the label 3 in the direction A.

With said movements A, B, it should be appreciated that it is the principal transfer movements of said label applicator plate 1 that are concerned. If it would be necessary to displace the label applicator plate 1 in the output direction 103 of the labels a short distance, i.e., perpendicular to the directions A, B, this cannot have an effect on the patent but this does not solve the problem that is solved according to claim 1. That is, if it is needed to go in and fetch the label 3 from the side of fed out label.

For clearing the label applicator plate 1 from contact with the outer situated dispenser edge 100 of the label printer where the backing paper web 101 of the label is deflected before detachment of the labels 3-3″ therefrom, as shown in FIG. 2, the label applicator plate 1 may move in an additional way. More precisely, before transportation away of the output printed label 3, the same is fetched by the label applicator plate 1 in question and the label applicator plate 1 is displaced with the label 3 carried thereon in a detachment direction 102, which is common with the output direction 103 of the label, so that the label applicator plate 1 after that is free to move in said two directions of travel A, B, which are essentially perpendicular to said detachment direction 102.

Figure 8:
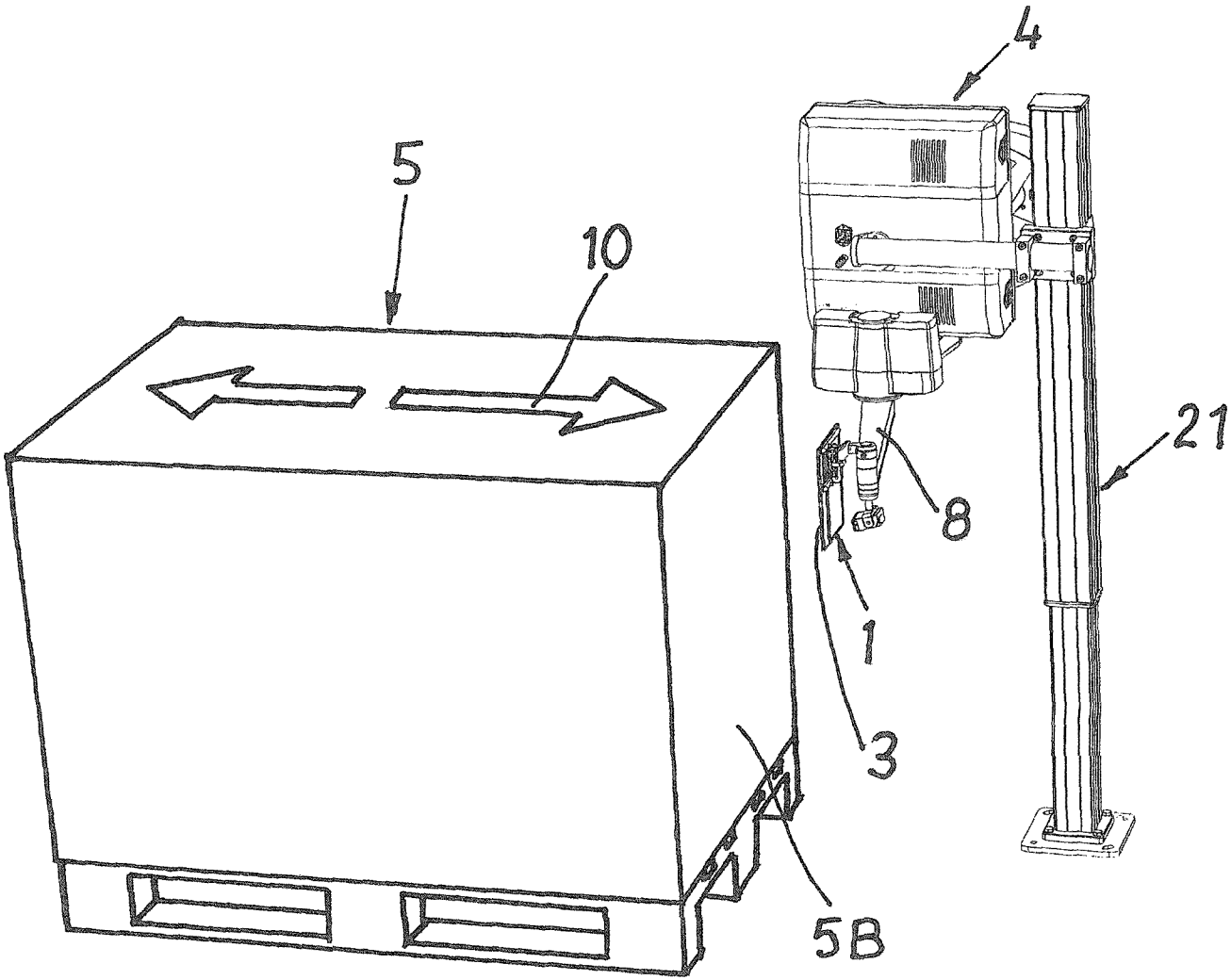
Figure 9:
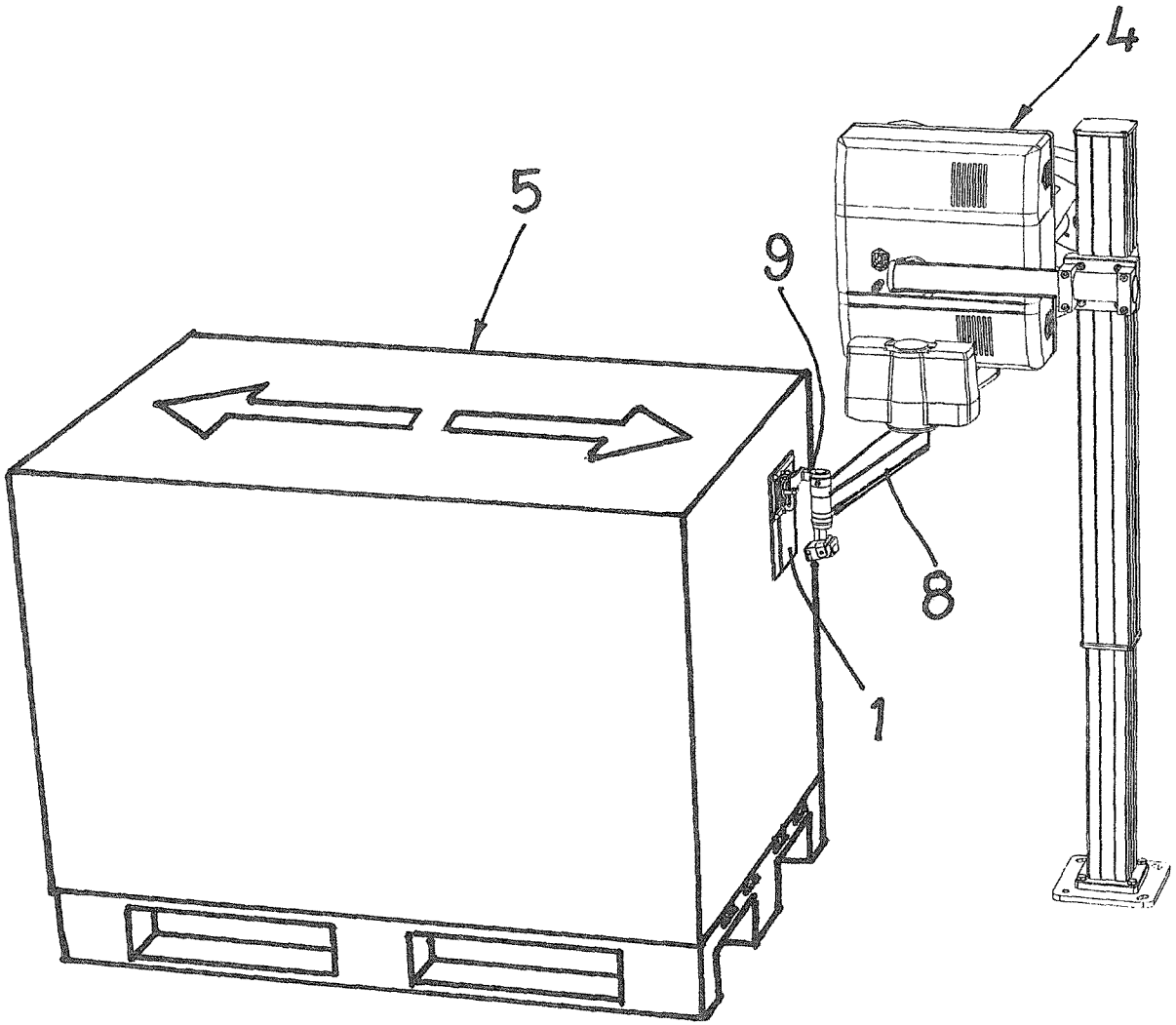
Figure 10:
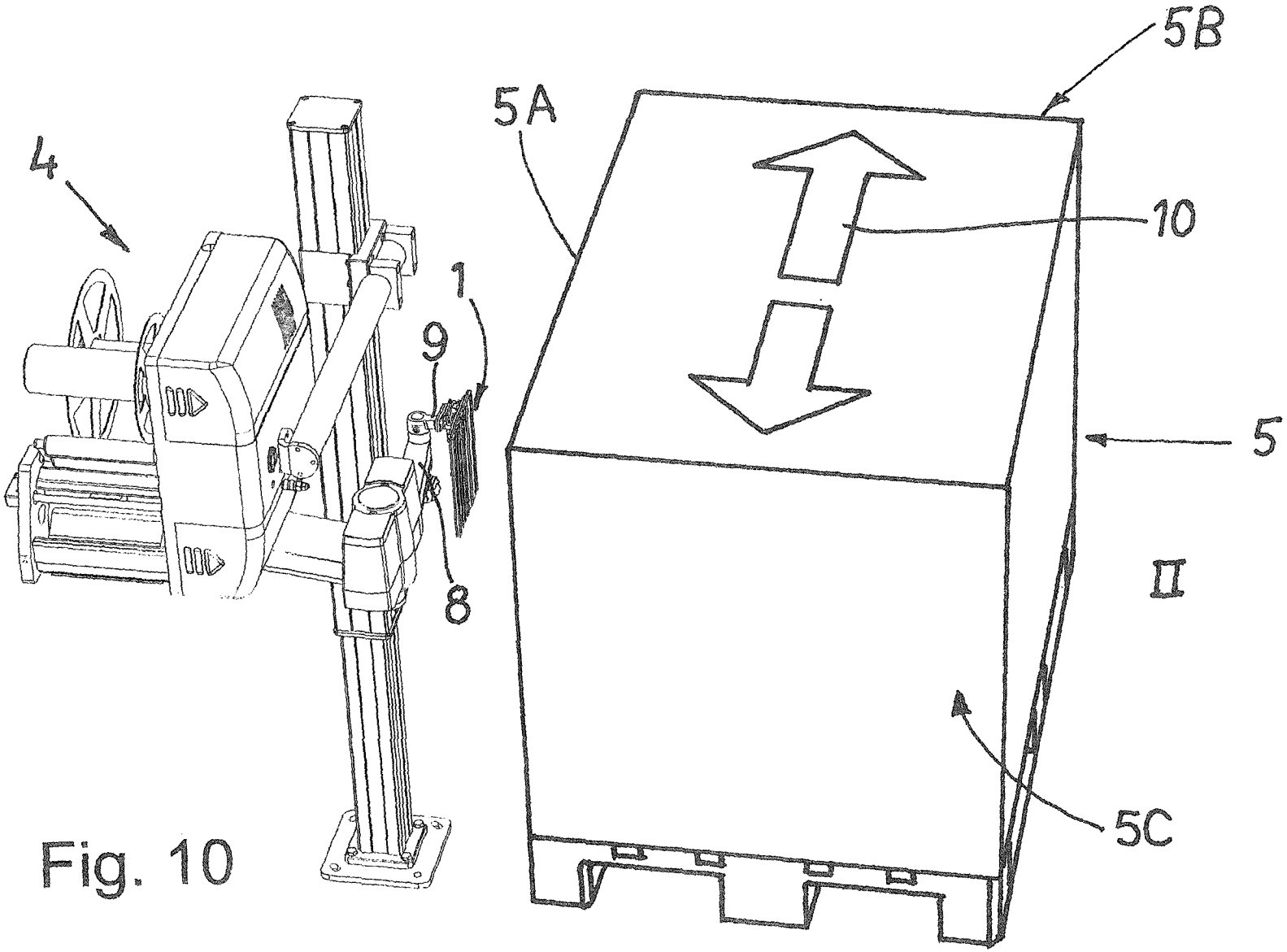
Figure 11:
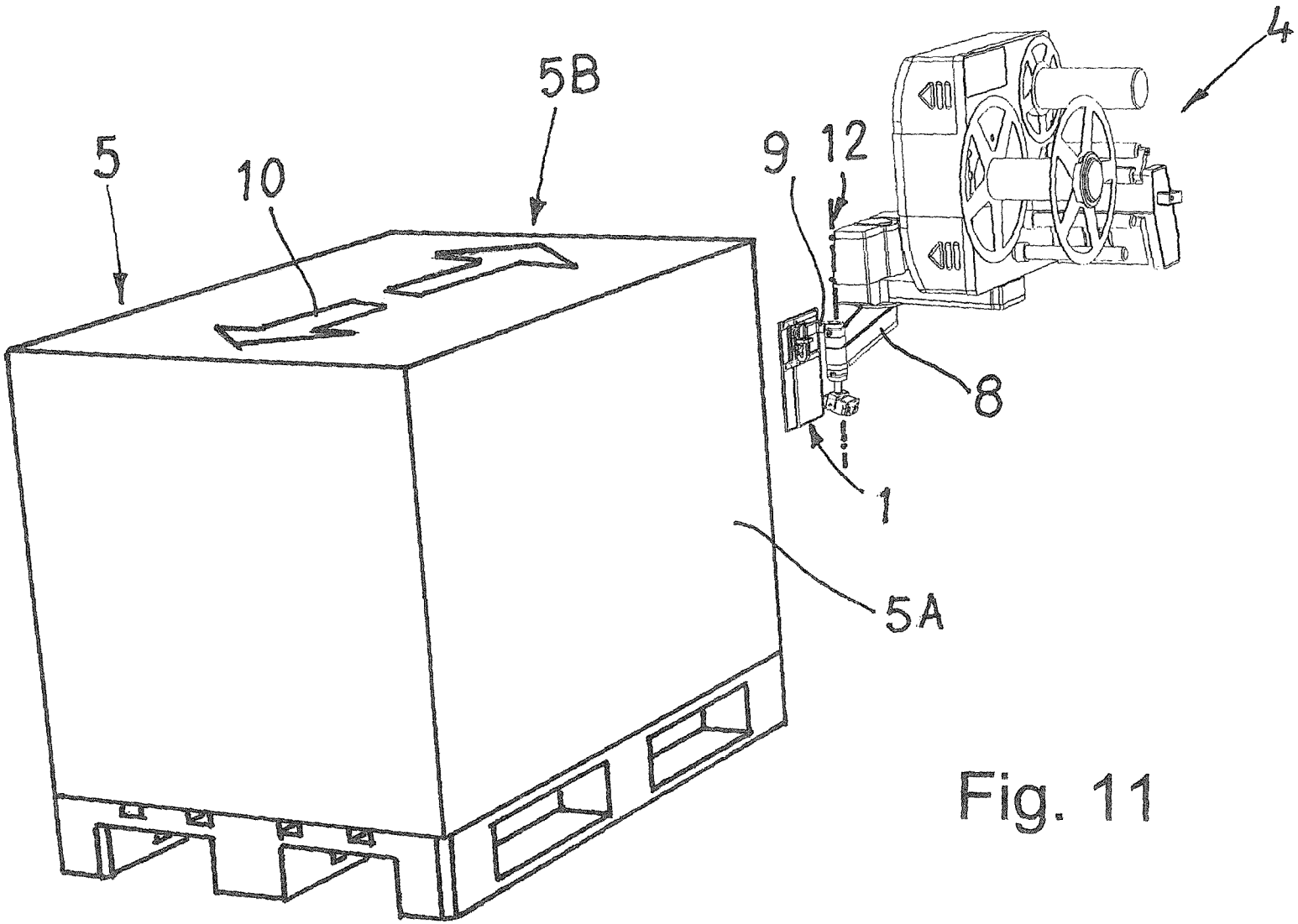
Figure 12:
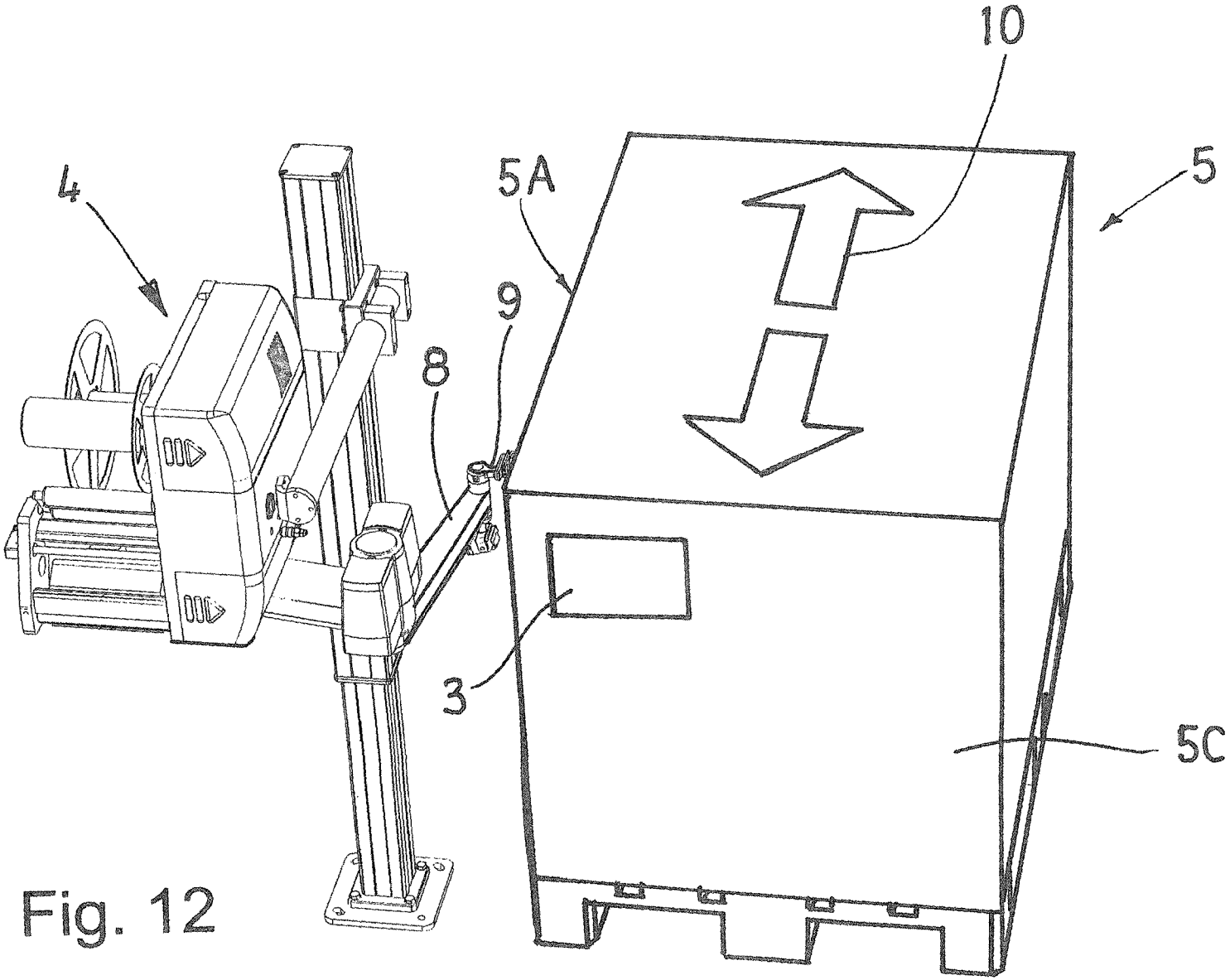
Figure 13:
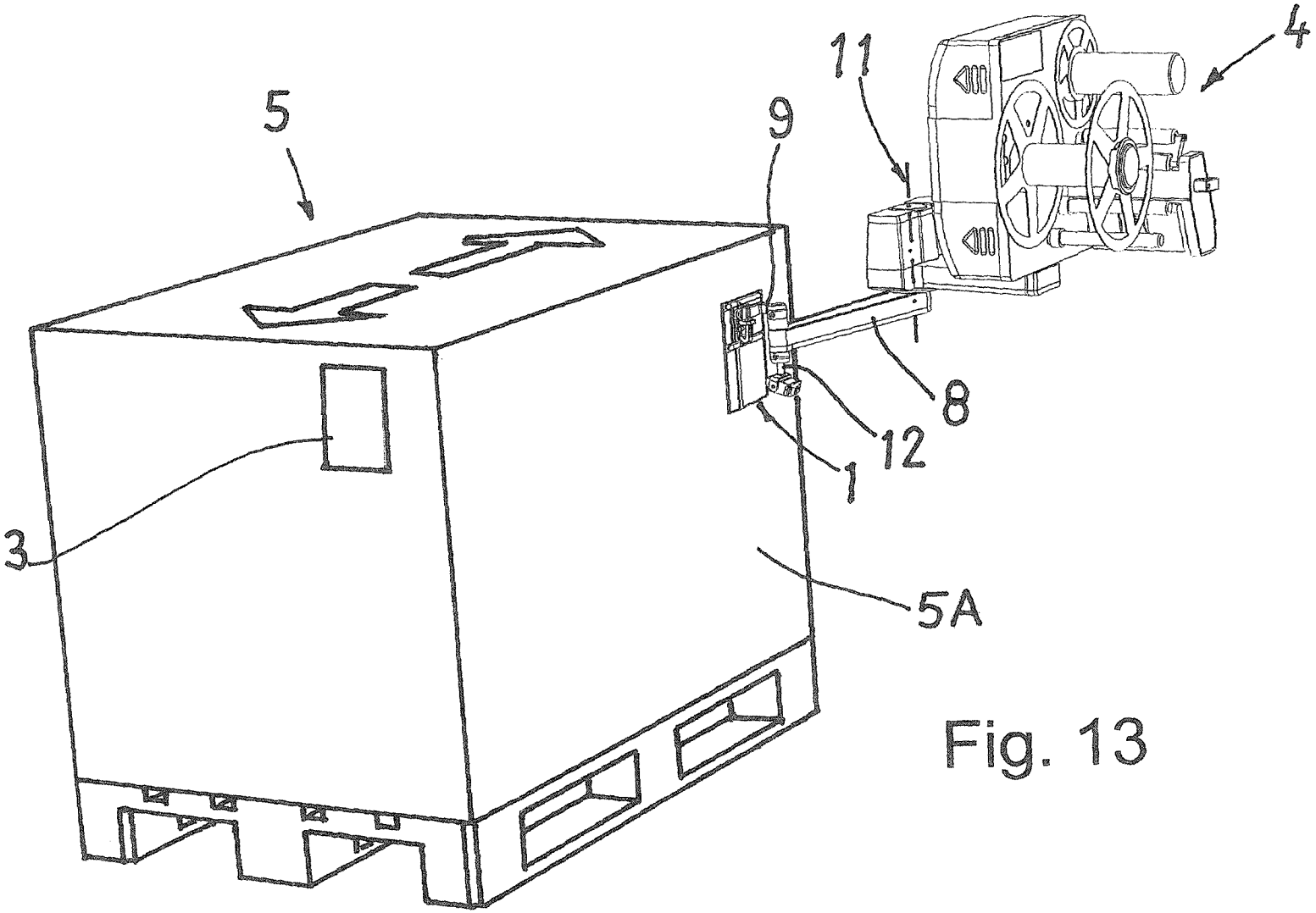
Figure 14:
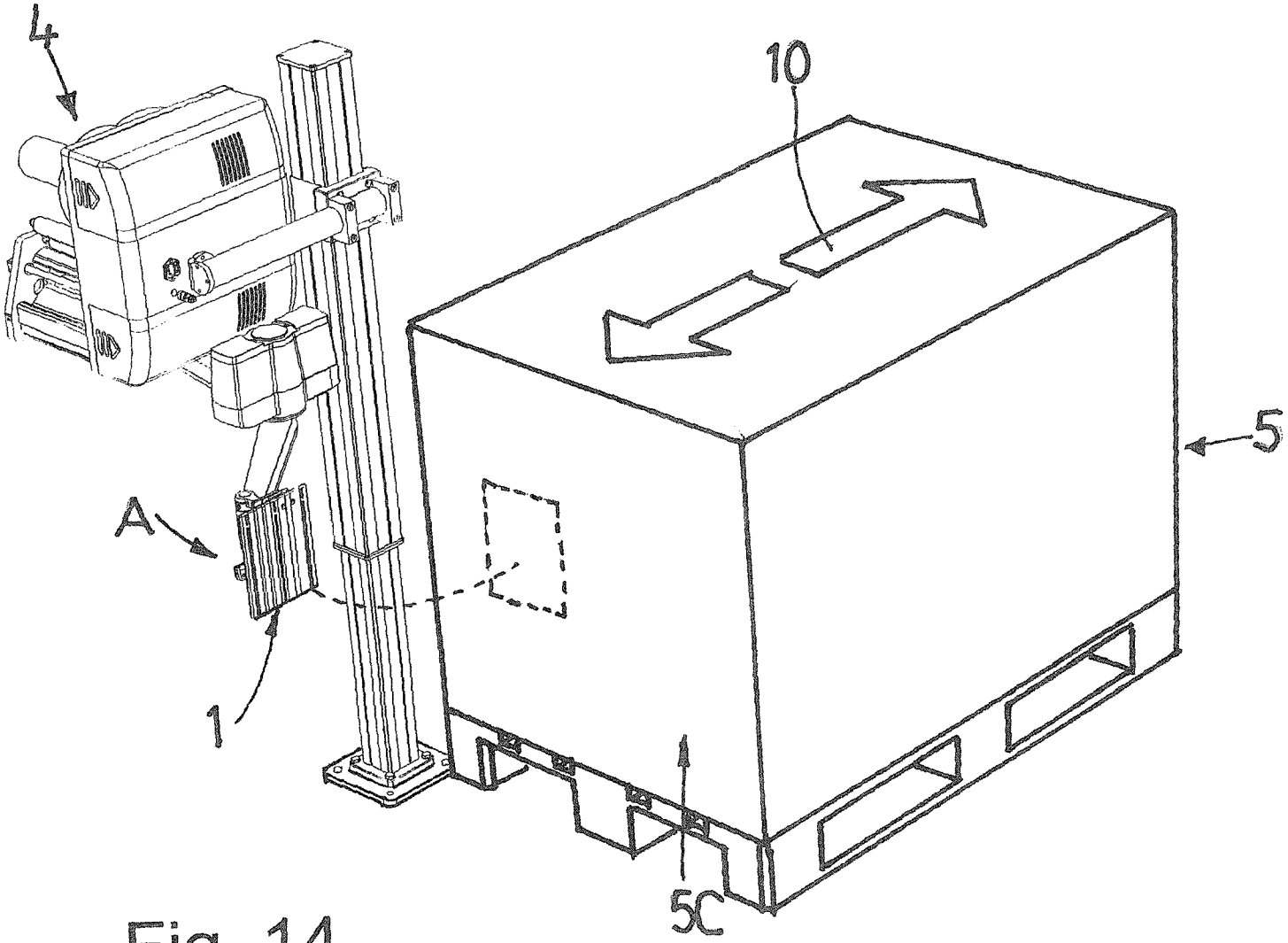
Figure 15:
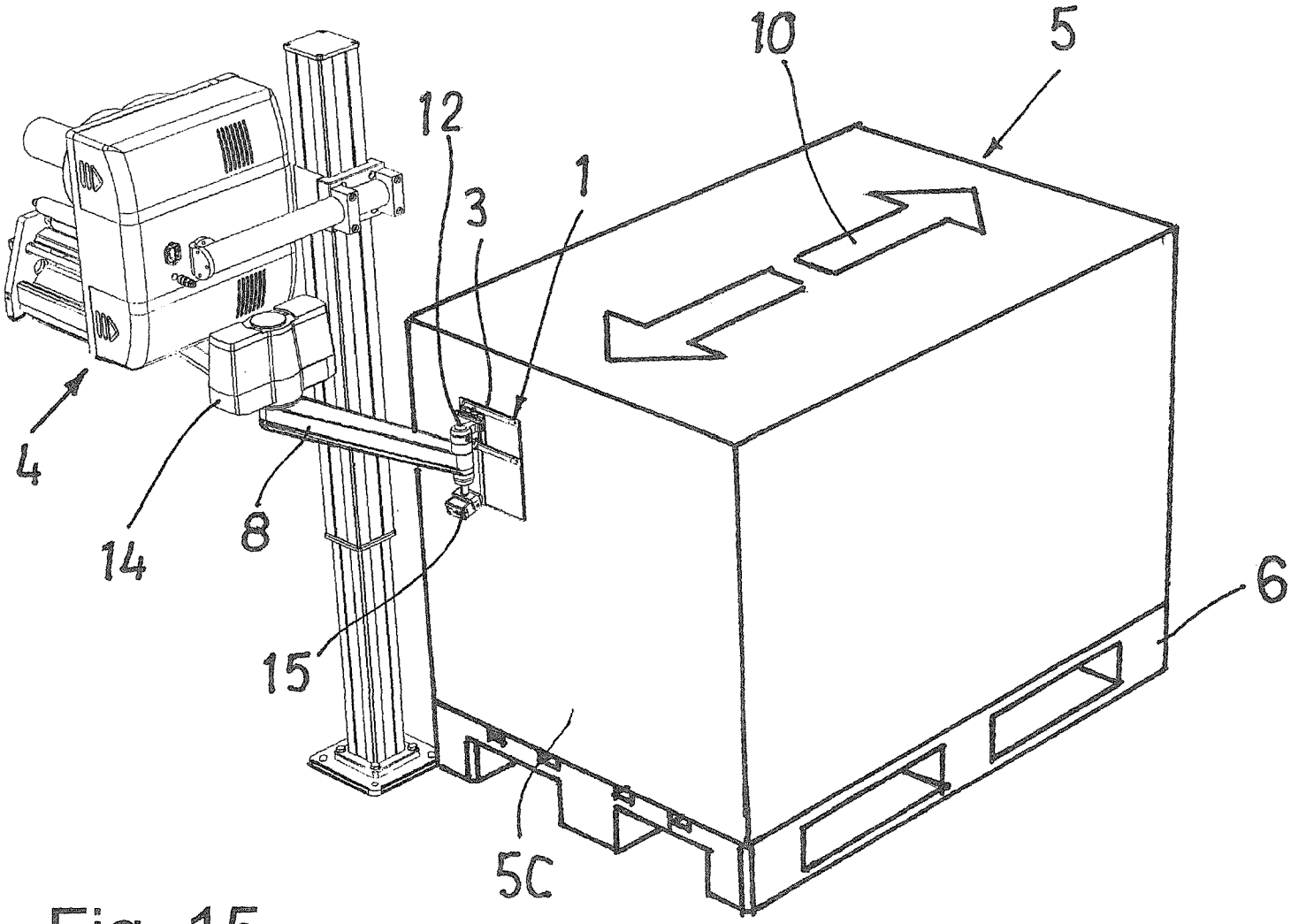

In FIGS. 8-9, there is shown how a label 3 is applied on the marking object 5 in the same position with the applicator plate 1 rotated to reach the front short end 5B of the marking object 5, but with the label printer 4 situated in the same position as before. Fetching of the label 3 is in that connection carried out in the direction B but that an outer swinging arm 9 is rotated around so that the adhesion agent 2 of the label will be facing said front short side 5B of the marking object 5 so that the label 3 adheres to the marking object 5, which in that connection has moved in the direction 10. Marking may in that connection take place with non-moving marking object 5 or when the same moves in the direction of transportation. The label 3 is in that connection taken in the direction of travel B.

FIGS. 10-15 show marking at the rear part of a said marking object when the marking object has moved to the position II so that the label printer 4 is situated at the rear part of the marking object. First, the label 3 is in that connection taken in the direction of travel A with the adhesion agent 2 facing the rear part of the long side 5A of the marking object for the attachment thereto according to FIGS. 10-13. Marking of the rear short side 5C of the marking object 5 is shown to take place in FIGS. 14-15 where the label 3 also is taken in the direction A and that the swinging arm 8 is turned around the rear pivot joint 11 thereof. Then, the front swinging arm 9, which is turnable around a pivot joint 12, does not need to be turned.

An arrangement 20 to apply labels 3 on marking objects 5 that are movable along a conveyor track 7 according to proceeding of the above-mentioned kind for, by a label applicator plate 1, collecting, transporting, and delivering labels 3 provided with adhesion agent 2 from a label printer 4 to intended marking object 5 such as cartons, pallets 6 with goods, bundles of items, sacks, barrels, etc., which is transported on a track 7 comprises in that connection only two pivot joints 11,12 and two swinging arms 8, 9 for carrying a label applicator plate 1 and for allowing putting the labels 3 in place on desired spots on one long side 5A of the marking object 5 in question, as seen in the direction of transportation 10, and on the two end portions 5B, 5C of the marking object. The swinging arms 8, 9 are in that connection arranged with such lengths and with such pivot joints 11, 12 that application is allowed to the side 5A, 5B, 5C of the marking object that is situated essentially parallel to, as well as perpendicularly to the direction of transportation 10 of the marking object 5.

The swinging arm 8, the primary arm, that is situated closest to the proper labelling machine 4, is turnable 360°. The outer swinging arm, the secondary swinging arm 9 is arranged to be turnable at least 200° but most preferably 360°. That is, that it can rotate around the pivot 12. The pivots 11, 12 of said joints extend essentially vertically, and the label applicator plate 1 is resiliently turnable around a pivot joint, not shown, so that said label applicator plate 1 is freely turnable like a ball-and-socket joint.

Motors 14, 15, or piston type cylinders, not described in more detail, drive said swinging arms 8, 9 to be turned in desired turning directions 16, 17 and 18, 19, respectively.

Furthermore, the two swinging arms 8, 9 are articulated turnable around a common pivot 12 and displaced from each other vertically. Preferably, the two swinging arms 8, 9 may be articulated turnable around a common pivot and that the arm ends that meet each other are connected similar to a turnable finger joint.

Furthermore, it should be mentioned that the applicator plate 1 is arranged to operate by suction function, provided using vacuum or fan.

The example shown comprises a pillar 21 on which the label printer 4 is carried with the swinging arms 8, 9 carried thereby turnable to reach up to intended marking objects 5. It is suitable to place the pillar 21 along the conveyor track 7 at a suitable distance to allow the swinging arms 8, 9 to be possible to be turned and reach up to the marking object 5 and apply labels 3 to desired sides 5A, 5B, 5C of the marking object 5. The pillar 21 is erected on the floor of the building in which the arrangement 20 is intended to operate but may also be attached in walls and in ceilings if required, depending on spaces available.

The pillar 21 may, for instance, be telescopic to allow varying the height at which it is desired to apply the labels 3 on the marking object 5 in question.

The marking objects 5 may naturally be marked even if they are transported in the opposite direction 10A of the load track 7 in the way according to the above mentioned.

The function and nature of the invention should have been clearly understood from the above-mentioned and also with knowledge of what is shown in the drawings but the invention is naturally not limited to the embodiments described above and shown in the accompanying drawings. Modifications are feasible, particularly as for the nature of the different parts, or by using an equivalent technique, without departing from the protection area of the invention, such as it is defined in the claims.

The invention claimed is:

1. A label applicator for applying labels on objects that are movable along a conveyor track, comprising:

a label printer;

a label applicator plate;

a primary swinging arm; and a secondary swinging arm;

wherein the secondary swinging arm carries the label applicator plate; the primary swinging arm and the secondary swinging arm are articulatedly turnable around a common pivot joint; the primary swinging arm is carried by the label applicator and is turnable 360° around a rear pivot joint; and the secondary swinging arm is turnable about the common pivot joint by at least 200°, and wherein pivots of the common pivot joint and rear pivot joint extend substantially vertically.

2. The label applicator of claim 1, wherein the label applicator plate is resiliently freely turnable around a third pivot joint.

3. The label applicator of claim 1, wherein the primary and secondary swinging arms are vertically displaced from each other.

4. The label applicator of claim 1, wherein the label applicator plate is configured to operate by suction.

5. The label applicator of claim 4, wherein the label applicator plate operates by vacuum or by fan.

6. A label applicator for applying labels on objects that are movable along a conveyor track, comprising:

a label printer;

a label applicator plate;

a primary swinging arm; and a secondary swinging arm;

wherein the secondary swinging arm carries the label applicator plate; the primary swinging arm and the secondary swinging arm are articulatedly turnable around a common pivot joint; the primary swinging arm is carried by the label applicator and is turnable about a rear pivot joint; and the secondary swinging arm is turnable about the common pivot joint, and wherein pivots of the common pivot joint and rear pivot joint extend substantially vertically.

7. The label applicator set forth in claim 6, wherein the conveyor track is constructed to move along a direction that is substantially perpendicular to the common pivot joint and the rear pivot joint.

* * * * *